US009155975B2

(12) United States Patent
Capriola

(10) Patent No.: US 9,155,975 B2
(45) Date of Patent: Oct. 13, 2015

(54) LAMP ADAPTER APPARATUS FOR USE WITH POWERED TOY BUILDING BLOCKS

(71) Applicant: Jonathan P. Capriola, Sarasota, FL (US)

(72) Inventor: Jonathan P. Capriola, Sarasota, FL (US)

( * ) Notice: Subject to any disclaimer, the term of this patent is extended or adjusted under 35 U.S.C. 154(b) by 0 days.

(21) Appl. No.: 14/188,343

(22) Filed: Feb. 24, 2014

(65) Prior Publication Data

US 2014/0170928 A1 Jun. 19, 2014

Related U.S. Application Data

(63) Continuation-in-part of application No. 13/959,522, filed on Aug. 5, 2013, now abandoned.

(60) Provisional application No. 61/679,597, filed on Aug. 3, 2012.

(51) Int. Cl.

| | |
|---|---|
| ***A63H 33/04*** | (2006.01) |
| ***H01R 33/92*** | (2006.01) |
| ***H01R 33/94*** | (2006.01) |

(52) U.S. Cl.

CPC ..... *A63H 33/042* (2013.01); *H01R 33/92* (2013.01); *H01R 33/94* (2013.01); *Y10T 29/49826* (2015.01)

(58) Field of Classification Search

USPC ..... 446/90, 91, 108, 117, 118; 313/1, 313/318.01; 315/276, 312

See application file for complete search history.

(56) References Cited

U.S. PATENT DOCUMENTS

| | | | | |
|---|---|---|---|---|
| 750,953 | A | | 2/1904 | Dunfee |
| 1,552,227 | A | | 9/1925 | Pacent |
| 1,642,064 | A | | 9/1927 | Engstrom |
| 2,440,661 | A | | 4/1948 | Calvin |
| 2,657,369 | A | | 10/1953 | Ziemianin Jr. |
| 2,703,393 | A | | 3/1955 | Bird |
| 2,731,614 | A | | 1/1956 | Geib et al. |
| 3,225,460 | A | | 12/1965 | Randell et al. |
| 3,237,341 | A | * | 3/1966 | Janning ..... 446/91 |
| 3,289,149 | A | | 11/1966 | Pawloski |

(Continued)

FOREIGN PATENT DOCUMENTS

| | | |
|---|---|---|
| CN | 2596479 | 12/2003 |
| EP | 1162400 | 12/2001 |
| KR | 101999-0078845 | 11/1999 |

OTHER PUBLICATIONS

PCT International Search Report dated May 27, 2011, entire document.

(Continued)

*Primary Examiner* — Kurt Fernstrom

(74) *Attorney, Agent, or Firm* — Allen Dyer Doppelt Milbrath & Gilchrist

(57) ABSTRACT

A lamp adapter apparatus includes a socket mount, a first mechanical connector, and an alternating current/direct current (AC/DC) adapter. The socket mount has a mount housing that carries a socket connector. The socket connector is configured to be releasably secured to a bulb receptacle of a lamp and receive AC electrical power from the lamp. The AC/DC adapter is connected between the socket connector and the first mechanical connector and converts the AC electrical power supplied from the lamp into the DC electrical power. A powered toy building block is connectable to the first mechanical connector of the lamp adapter apparatus and thereby receives electrical power from the lamp.

22 Claims, 9 Drawing Sheets

(56) References Cited

U.S. PATENT DOCUMENTS

| | | | | |
|---|---|---|---|---|
| 3,418,438 | A | 12/1968 | Barrett | |
| 3,447,249 | A | 6/1969 | Greger | |
| 3,484,984 | A | 12/1969 | Fischer | |
| 3,553,883 | A | 1/1971 | Fischer | |
| 3,576,936 | A | 5/1971 | Fischer | |
| 3,589,056 | A * | 6/1971 | Glass et al. | 446/91 |
| 3,626,360 | A | 12/1971 | Cole | |
| 3,696,548 | A | 10/1972 | Teller | |
| 4,096,379 | A | 6/1978 | Taylor | |
| 4,223,377 | A | 9/1980 | Williams | |
| 4,305,221 | A | 12/1981 | Chatani | |
| 4,306,373 | A | 12/1981 | Chatani et al. | |
| 4,869,701 | A | 9/1989 | Kawai et al. | |
| 4,891,030 | A * | 1/1990 | Gertzfeld | 446/118 |
| 5,018,980 | A | 5/1991 | Robb | |
| 5,020,253 | A | 6/1991 | Lie et al. | |
| 5,409,403 | A | 4/1995 | Falossi et al. | |
| 5,445,552 | A | 8/1995 | Hine | |
| 5,778,579 | A | 7/1998 | Yuen | |
| 5,779,515 | A * | 7/1998 | Chung | 446/90 |
| 5,876,262 | A * | 3/1999 | Kelly et al. | 446/118 |
| 6,019,486 | A | 2/2000 | Stewart, Jr. | |
| 6,113,433 | A * | 9/2000 | Al-Turki | 439/639 |
| 6,241,371 | B1 | 6/2001 | Dai | |
| 6,443,796 | B1 * | 9/2002 | Shackelford | 446/91 |
| 6,585,553 | B1 | 7/2003 | Fetridge et al. | |
| 6,805,605 | B2 | 10/2004 | Reining et al. | |
| 7,080,927 | B2 | 7/2006 | Feuerborn et al. | |
| 7,102,296 | B1 * | 9/2006 | Munter et al. | 315/276 |
| 7,255,624 | B2 | 8/2007 | Daftari | |
| 7,322,873 | B2 | 1/2008 | Rosen et al. | |
| 7,724,236 | B2 * | 5/2010 | Weil et al. | 345/156 |
| 7,731,558 | B2 * | 6/2010 | Capriola | 446/91 |
| 7,846,002 | B1 * | 12/2010 | Mikesell et al. | 446/91 |
| 8,079,890 | B2 * | 12/2011 | Seligman | 446/124 |
| 8,410,726 | B2 * | 4/2013 | Dau et al. | 315/312 |
| 8,651,913 | B1 * | 2/2014 | Lin | 446/91 |
| 8,864,546 | B1 * | 10/2014 | Capriola | 446/91 |
| 8,872,417 | B2 * | 10/2014 | Fatt et al. | 313/318.01 |
| 2002/0115373 | A1 | 8/2002 | Lazeman | |
| 2003/0040250 | A1 | 2/2003 | Yim et al. | |
| 2003/0148700 | A1 | 8/2003 | Arlinsky et al. | |
| 2004/0018473 | A1 | 1/2004 | Tusacciu | |
| 2004/0185745 | A1 | 9/2004 | Reining et al. | |
| 2006/0084357 | A1 | 4/2006 | Rosen et al. | |
| 2006/0134978 | A1 | 6/2006 | Rosen et al. | |
| 2007/0184722 | A1 | 8/2007 | Doherty | |
| 2008/0139077 | A1 | 6/2008 | Patton | |
| 2008/0160875 | A1 | 7/2008 | Leicht | |
| 2008/0268742 | A1 * | 10/2008 | Shenhar | 446/225 |
| 2010/0330843 | A1 * | 12/2010 | Gao et al. | 439/620.21 |
| 2012/0104928 | A1 * | 5/2012 | Huang et al. | 313/318.01 |

OTHER PUBLICATIONS

Inter Partes Review of U.S. Pat. No. 7,731,558, Petition A filed with the US Patent and Trademark Office on Jan. 23, 2013.

Inter Partes Review of U.S. Pat. No. 7,731,558, Petition B filed with the US Patent and Trademark Office on Jan. 23, 2013.

* cited by examiner

LAMP ADAPTER APPARATUS FOR USE WITH POWERED TOY BUILDING BLOCKS

CROSS-REFERENCE TO RELATED APPLICATIONS

This application is a continuation-in-part of U.S. application Ser. No. 13/959,522 filed on Aug. 5, 2013, which claims the benefit of U.S. Provisional Application Ser. No. 61/679,597 filed on Aug. 3, 2012, the contents of which applications are herein incorporated by reference in their entirety.

FIELD OF THE INVENTION

The present invention relates generally to powered toy building blocks, and more generally, to apparatus for supplying to electrical power thereto.

BACKGROUND OF THE INVENTION

The present inventor has previously developed powered toy building blocks, including connectable blocks with low-voltage, direct-current (DC) powered light-emitting diodes (LEDs) therein. Examples of such building blocks can be seen in the present inventor's U.S. Pat. No. 7,731,558, and pending U.S. patent application Ser. No. 12/547,183, Ser. No. 13/534,088, and No. 61/662,557, the contents of all of the foregoing being incorporated by reference herein in their entirety.

While many alternative power sources have been advanced to support and/or power these building blocks, further improvements are possible.

SUMMARY OF THE INVENTION

In view of the foregoing background, an object of the present invention is to provide a lamp adapter apparatus for use with powered toy building blocks. According to an aspect of the present invention, a lamp adapter apparatus comprises a socket mount, a first mechanical connector, and an alternating current/direct current (AC/DC) adapter. The socket mount has a mount housing that carries a socket connector. The socket connector is configured to be releasably secured to a bulb receptacle of a lamp and receive AC electrical power from the lamp. The AC/DC adapter is connected between the socket connector and the first mechanical connector and converts the AC electrical power supplied from the lamp into the DC electrical power. A powered toy building block is connectable to the first mechanical connector of the lamp adapter apparatus and thereby receives electrical power from the lamp.

According to one aspect of the present invention, the first mechanical connector is located on the mount housing of the socket mount. In another embodiment, the lamp adapter apparatus includes an expanded connector platform connected to the socket mount, either releasable or permanently, with the first mechanical connector located on the expanded connector platform. Advantageously, the expanded connector platform can be configured in a variety of shapes and sizes capable of supporting a plurality of mechanical connectors allowing for the connection of additional powered toy building blocks.

According to a method aspect of the present invention, a method of using the lamp adapter apparatus with powered toy building blocks comprises connecting the lamp adapter apparatus to a lamp, connecting a powered toy building block to the lamp adapter apparatus via complimentary mechanical connectors of the powered toy building block and the lamp adapter apparatus, and supplying electrical power to the first powered toy building block from the lamp via the lamp adapter apparatus. According to a further method aspect of the present invention, an additional powered toy building block is connected to the first powered toy building block by complimentary mechanical connectors, wherein the mechanical connectors have a cylindrical non-conductive body with two conductors traversing each body such that the complimentary mechanical connectors can be connected at any degree of rotation about a connection axis while maintaining a complete electrical circuit.

These and other aspects, objects and advantages of the present invention will be better appreciated in view of the drawings and following detailed description of preferred embodiments.

DETAILED DESCRIPTION OF PREFERRED EMBODIMENTS

Figure 1:
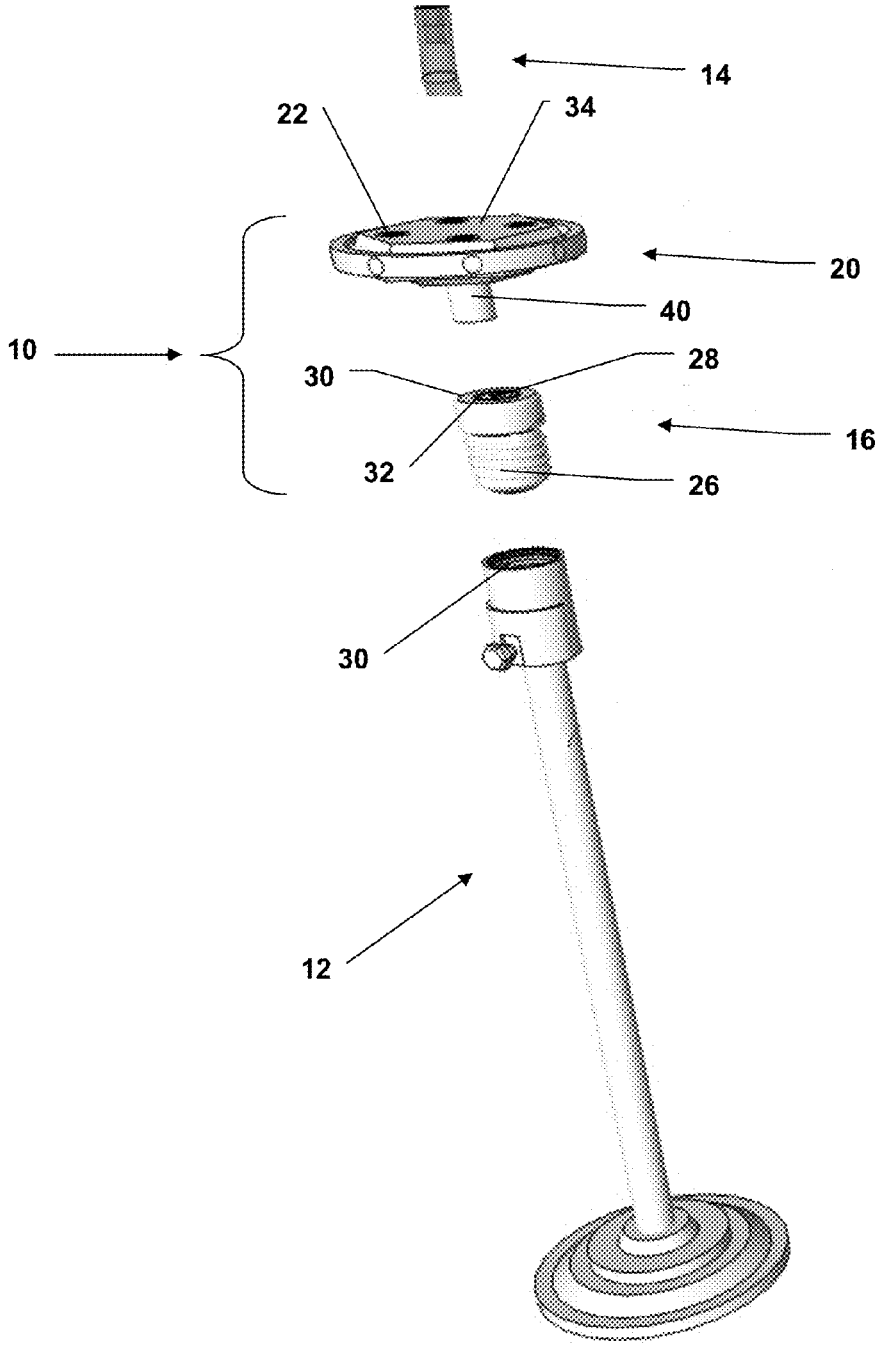
FIG. 1 is a partially exploded perspective view of a lamp adapter apparatus including a socket mount and an expanded connector platform, according to an embodiment of the present invention, together with a lamp and a powered toy building block.

According to an embodiment of the present invention, referring to FIG. 1, a lamp adapter apparatus 10 connects a lamp 12 to a powered toy building block 14, allowing the powered toy building block 14 to receive electrical power from the lamp 12. Advantageously, the lamp adapter apparatus 10 includes a socket mount 16, an expanded connector platform 20, and a plurality of mechanical connectors 22. The powered toy building blocks 14 connect to the lamp adapter apparatus 10 via the plurality of mechanical connectors 22 and receive electrical power therefrom.

Figure 2:
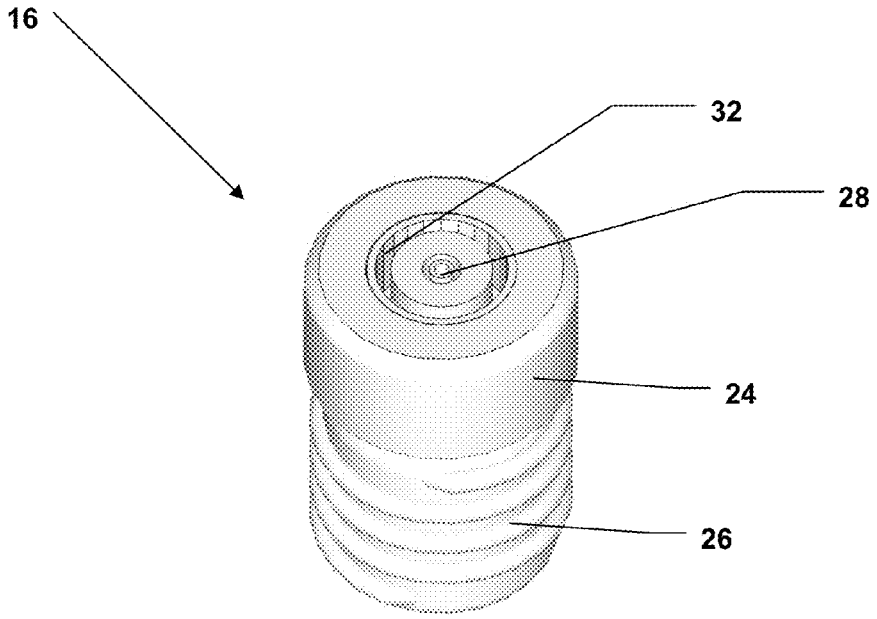
FIG. 2 is a perspective view of the socket mount of FIG. 1.

Referring to FIG. 2, the socket mount 16 has a mount housing 24 defining a socket connector 26 and a mechanical connector 28. The socket connector 26 is configured to be received into a bulb receptacle 30 of the lamp 12 in the same manner as a light bulb, allowing the lamp adapter apparatus 10 to receive electrical power from the lamp 12. In the depicted embodiment, the socket connector 26 is an Edison screw, but other lamp connections could be employed, including, bayonet, bi-pin, wedge, etc. The mechanical connector 28 can be configured to connect to the expanded connector platform 20. Preferably, the mechanical connector 28 is substantially identical to the plurality of mechanical connectors 22 such that a powered toy building block 14 could be inserted directly into the socket mount 16 via the mechanical connector 28. In the depicted embodiment, the mechanical connector 28 is surrounded by an annular recess 32 allowing for increased structural support to the connection between the socket mount 16 and the expanded connector platform 20 or the powered toy building block 14.

Figure 3:
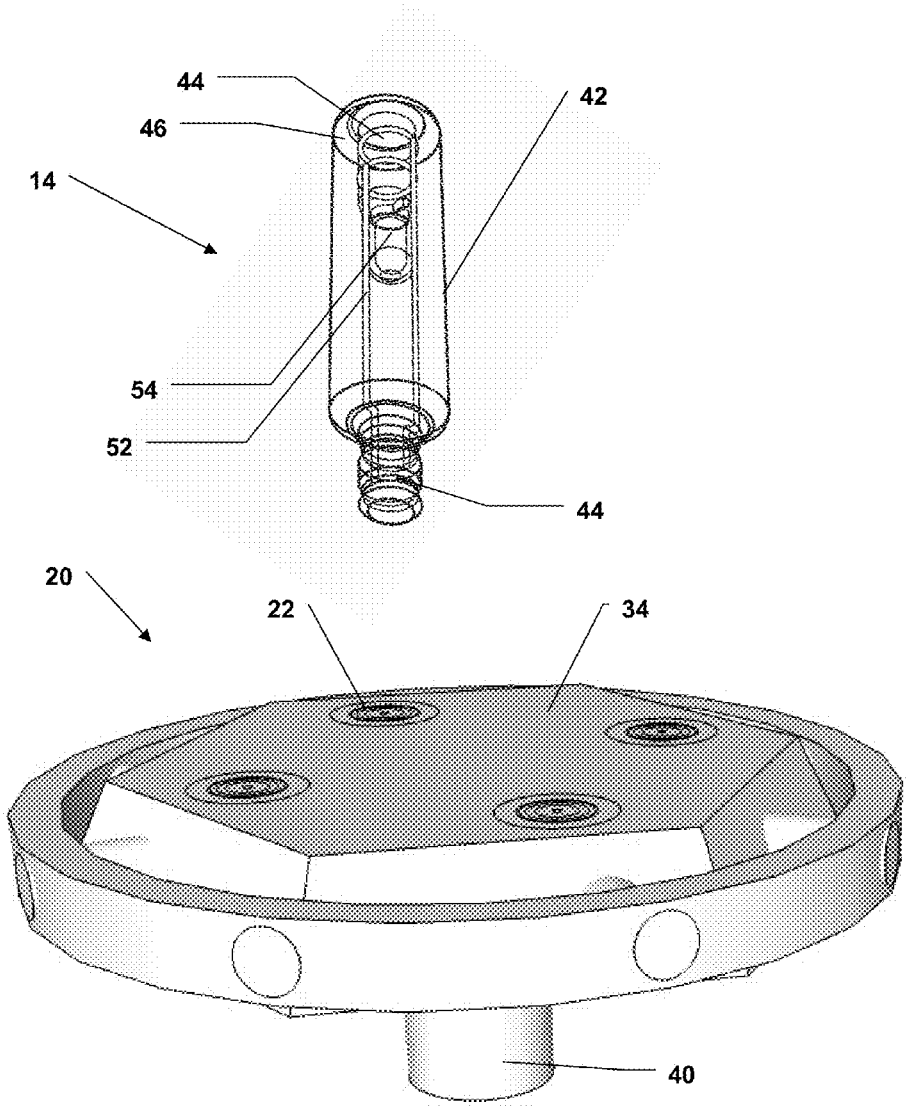
FIG. 3 is a perspective view of the expanded connector platform and powered toy building block of FIG. 1.
Figure 4:
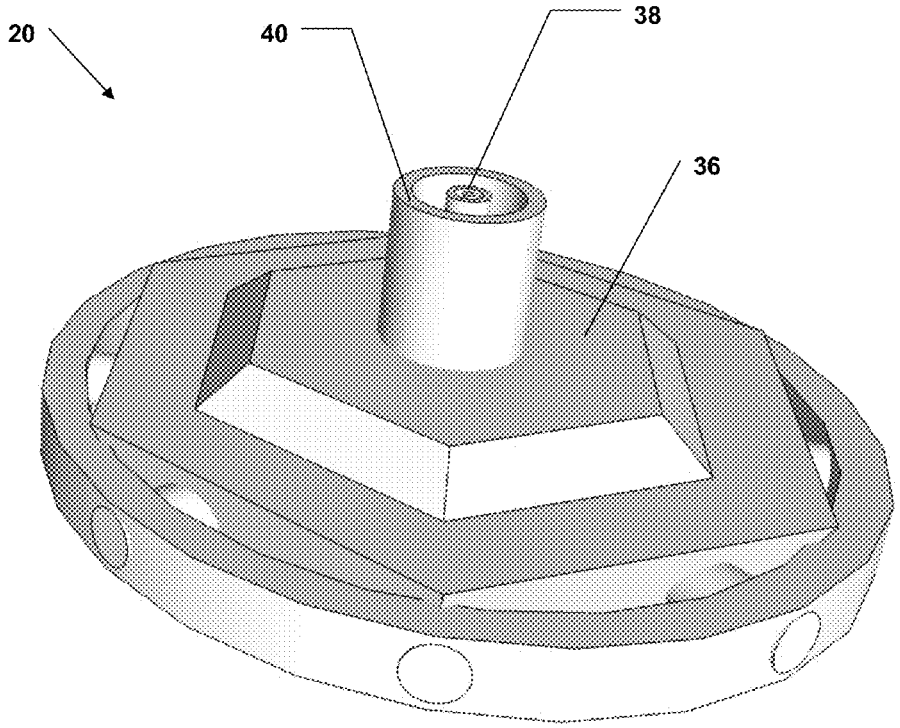
FIG. 4 is another perspective view of the expanded connector platform of FIG. 1.

Referring to FIGS. 3 and 4, the expanded connector platform 20 has upper and lower faces 34, 36. The plurality of mechanical connectors 22 are located on the upper face 34 of the expanded connector platform 20. A mechanical connector 38 is located on the lower face 36 of the expanded connector platform 20. A support ring 40 surrounds the mechanical connector 38. Mechanical connectors 28, 38 connect, with the annular recess 30 receiving the support ring 40, to releasably secure the expanded connector platform 20 to the socket mount 16. This configuration allows for the interchanging of differently-configured expanded connector platforms 20 without changing the socket mount 16, as well as simplifies the installation of the lamp adapter apparatus 10. Additionally, this configuration allows for the use of the same expanded connector platform 20 with different socket mounts 16 carrying differently-styled socket connectors 26. In another embodiment, the expanded connector platform 20 and the socket mount 16 could be a single unit eliminating the need for the mechanical connectors 28, 38.

Figure 5:
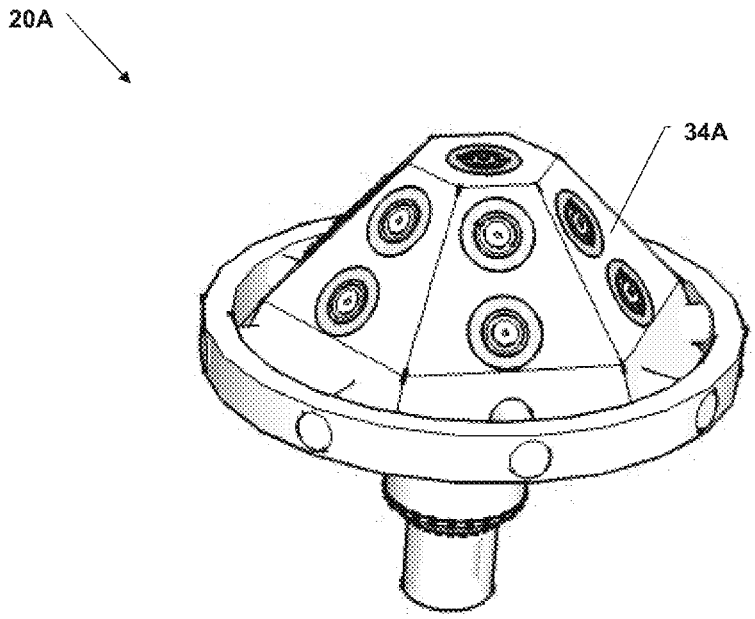
FIG. 5 is a perspective view of an expanded connector platform, according to another embodiment of the present invention.

With continuing reference to FIG. 3, the upper face 34 of the expanded connector platform 20 is a planar surface (such as a hexagon). However, it will be appreciated that the expanded connector platform can be designed in a variety of shapes and sizes capable of supporting any number of building block connectors 44 at various orientations. For example, referring to FIG. 5, the upper face 34A of the expanded connector platform 20A includes a plurality of surfaces forming a truncated hexagonal pyramid.

Figure 6:
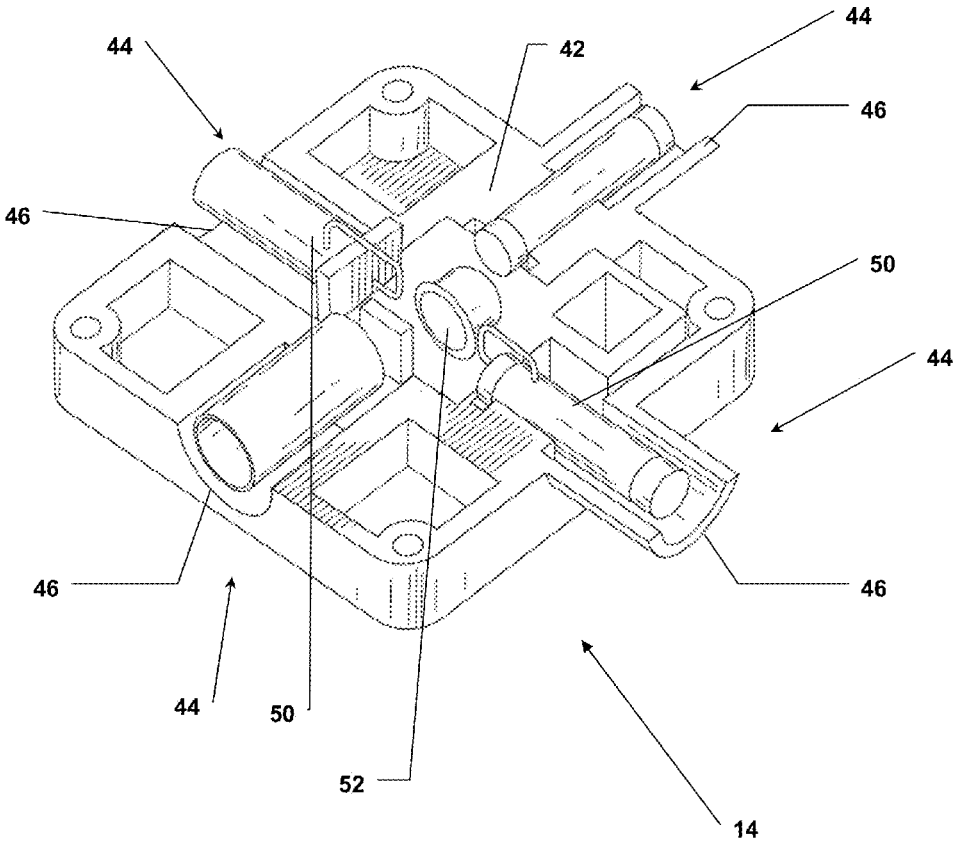
FIG. 6 is a perspective view of a powered toy building block, with components removed to show inner details, usable in connection with a lamp adapter apparatus according to the present invention.

Referring to FIG. 6, the powered toy building block 14 includes a body 42 carrying a plurality of block connectors 44 configured to be releasably secured into the plurality of mechanical connectors 22. Preferably, the block connectors 44 (and the mechanical connectors 22, 28, 38) have non-conductive cylindrical bodies 46 with two electrical conductors 50 traversing each body 46 such that a mechanical and electrical connection can be made at any degree of rotation about the connection axis therebetween. In the depicted embodiments, the mechanical connectors 22, 28 are female while the mechanical connector 38 and the block connector 44 are male. However, the male and female connectors could be reversed or other types of complementary mechanical connectors with electrical conductors could also be used. A light emitting diode (LED) 52 can be arranged within the body 42 of the powered toy building block 14 and electrically connected to the at least two of the electrical conductors 50 such that when the powered toy building block 14 is connected to the lamp adapter apparatus 10 and receives electrical power, the LED 52 illuminates.

Advantageously, the two electrical conductors 50 also traverse the body 42 of the powered toy building block 14 from each block connector 44 to each other block connector 44 such that connecting an additional powered toy building block to the first powered toy building block 14 also illuminates the LED 52 of the additional powered toy building block 14. It will be appreciated that the present invention is not limited to use with the powered toy building block 14 described herein but may be connected to differently-configured powered toy building blocks having block connectors configured to be received into the plurality of mechanical connectors. For example, the powered toy building block 14 may carry a speaker to generate sound effects upon receiving electrical power and/or video display to generate an image upon receiving electrical power.

Figure 7:
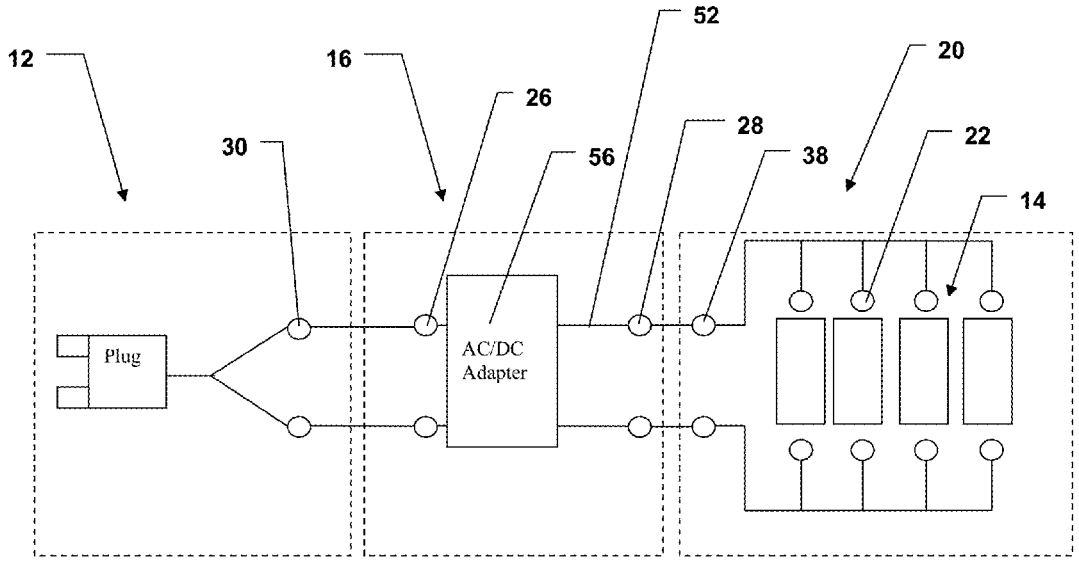
FIG. 7 is an electrical schematic of the lamp adapter of FIG. 1.

As shown in FIG. 7, an AC/DC adapter 54 is integrated into the socket mount 16 that rectifies and converts the AC electrical power from the lamp 12 to low voltage DC (such as 4.5 volts) to be supplied to the powered toy building block 14. Advantageously, this configuration allows for the use of different expanded connector platforms 20 with a single socket mount 16. The AC electrical power from the lamp 12 preferably ranges from 100 to 130 volts AC. The DC electrical power supplied to the powered toy building block 14 from the AC/DC adapter 54 preferably ranges 3 to 8 volts DC.

Figure 8:
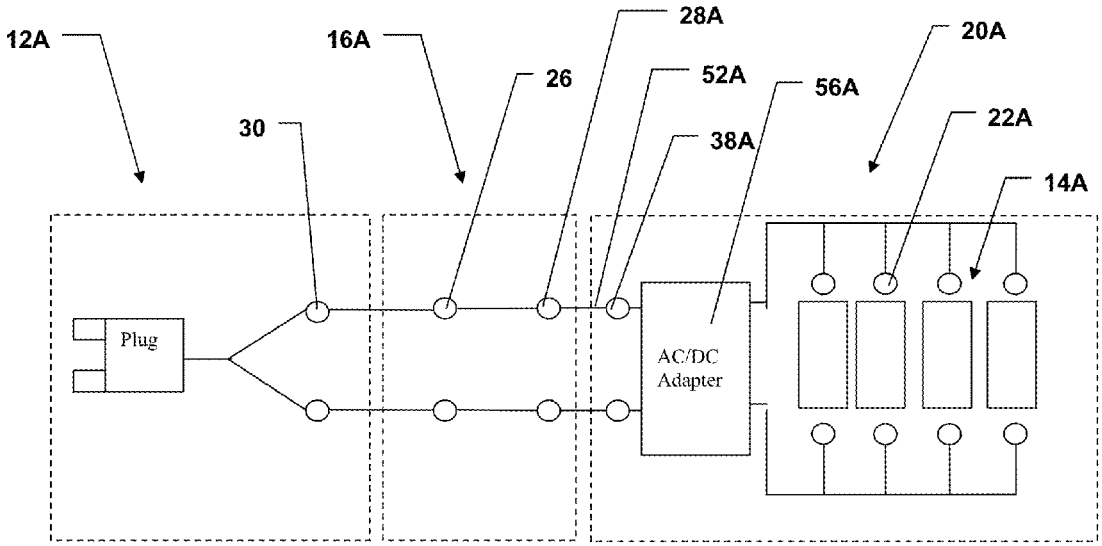
FIG. 8 is an electrical schematic of a lamp adapter apparatus, according to another embodiment of the present invention.

However, as shown in FIG. 8, the AC/DC adapter 54A can also be located in the expanded connector platform 20A. Alternatively, the AC/DC adapter 54 can be located in the powered toy building block 14 (not shown). If the lamp 12 supplies DC electrical power, the AC/DC adapter 54 is not needed although some conversion may be required based on the level of the DC voltage input.

In use, a light bulb (if installed) is removed from the bulb receptacle 30 of the lamp 12. The lamp adapter apparatus 10 is installed in its place by connecting the socket connector 26 to the bulb receptacle 30 of the lamp 12. The expanded connector 20 platform is connected to the socket mount 16 (if separate) via the mechanical connectors 28, 38, either before or after installing the socket mount 16 into the bulb receptacle 30.

Figure 9:
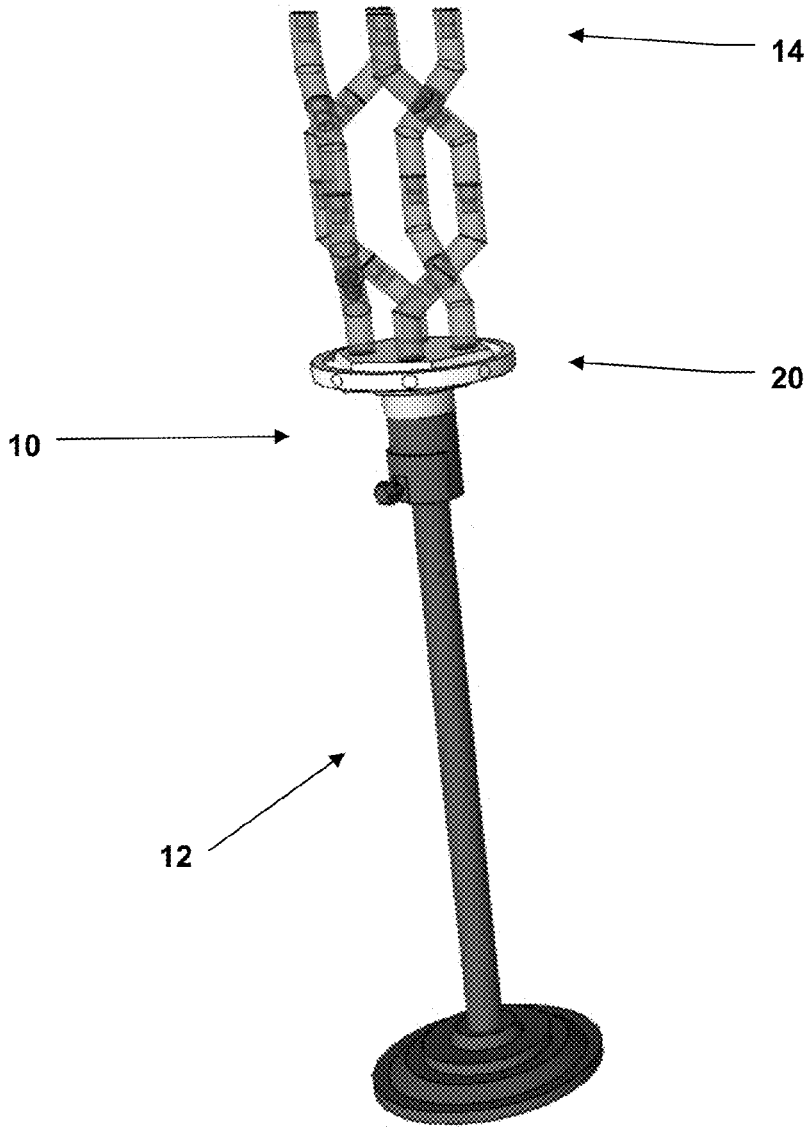
FIG. 9 is a perspective view of the lamp adapter apparatus of FIG. 1, installed on the lamp with a plurality of powered toy building blocks connected thereto.

As shown in FIG. 9, either before or after the expanded connector platform 20 is plugged into the socket mount 16 and/or connected to the lamp, a user can build models with powered toy building blocks 14 on the expanded connector platform 20. With the expanded connector platform 20 connected to the socket mount 16 and power being supplied from the lamp, the powered toy building blocks 14 can illuminate, generate sound effects and the like. The more illuminated toy building blocks 14 that are connected to the expanded connector platform 20, the more light a user will receive from the lamp.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereafter.

What is claimed is:

1. A lamp adapter apparatus for use with powered toy building blocks comprising:

a socket mount having a mount housing carrying a socket connector configured to be releasably secured to a bulb receptacle of a lamp and receive alternating-current (AC) electrical power therefrom;

a first mechanical connector having a first connector body carrying a first pair of electrical conductors configured to receive a complementary mechanical connector of a powered toy building block and supply direct-current (DC) electrical power thereto; and an AC/DC adapter connected between the socket connector and the first mechanical connector operable to convert the AC electrical power supplied form the lamp into the DC electrical power supplied to the powered toy building block; and an expanded connector platform releasably secured to the mount housing, the first mechanical connector being located on the expanded connector platform.

2. The lamp adapter apparatus of claim 1, wherein a platform diameter is greater than a mount housing diameter.

3. The lamp adapter apparatus of claim 1, wherein the AC/DC adapter is arranged within the mount housing.

4. The lamp adapter apparatus of claim 1, wherein the AC/DC adapter is arranged within the expanded connector platform.

5. The lamp adapter apparatus of claim 1, further comprising a second mechanical connector located on the mount housing, and a third mechanical connector located on the expanded connector platform releasably secured to the second mechanical connector.

6. The lamp adapter apparatus of claim 5, wherein the AC/DC adapter is arranged within the mount housing, and the DC electrical power is supplied to the first mechanical connector via the second and third mechanical connectors.

7. The lamp adapter apparatus of claim 5, wherein the mount housing further comprises an annular recess, the annular recess surrounding the second mechanical connector.

8. The lamp adapter apparatus of claim 5, wherein the expanded connector platform further comprises a support ring, the support ring surrounding the third mechanical connector.

9. The lamp adapter apparatus of claim 1, wherein the first connector body is cylindrical and non-conductive, such that the first mechanical connector is mechanically and electrically connectable to a complementary mechanical connector of a powered toy building block at any degree of rotation about a connection axis while maintaining a complete electrical circuit.

10. The lamp adapter apparatus of claim 1, wherein the expanded connector platform includes at least one additional mechanical connector identical to the first mechanical connector.

11. The lamp adapter apparatus of claim 10, wherein the first mechanical connector and the at least one additional mechanical connector are commonly located on a planar surface of the expanded connector platform.

12. The lamp adapter apparatus of claim 10, wherein the expanded connector platform further comprises a plurality of planar surfaces, said plurality of planar surfaces including further mechanical connectors identical to the first mechanical connector.

13. The lamp adapter apparatus of claim 12, wherein the plurality of planar surfaces form a truncated pyramid.

14. The lamp adapter apparatus of claim 1, wherein the AC/DC adapter converts from approximately 120 volts AC to approximately 5 volts DC.

15. A method of using a lamp adapter apparatus with powered toy building blocks comprising:

connecting a lamp adapter apparatus to a lamp;

connecting a first powered toy building block to the lamp adapter apparatus via complimentary first mechanical connectors; and supplying electrical power to the first powered toy building block from the lamp via the lamp adapter apparatus;

wherein connecting the lamp adapter apparatus to the lamp includes securing a socket mount having a mount housing to a bulb receptacle of the lamp and releasably securing an expanded connector platform, on which the first mechanical connector is located, to the mount housing.

16. The method of claim 15, wherein securing the socket mount includes screwing a socket connector located on the mount housing into the bulb receptacle.

17. The method of claim 15, wherein releasably securing the expanded connector platform to the mount housing further includes securing a second mechanical connector located on the mount housing to a third mechanical connector located on the expanded connector platform.

18. The method claim of 17, wherein connecting the first powered toy building block to the lamp adapter apparatus further includes securing a building block connector into the first mechanical connector, whereby the powered toy building block connector and the first mechanical connector each include a complimentary non-conductive cylindrical body and two electrical conductors traversing the length of each body such that that the first mechanical connector is mechanically and electrically connectable to the building block connector at any degree of rotation about a connection axis while maintaining a complete electrical circuit.

19. The method of claim 18, further comprising connecting an additional powered toy building block to an additional mechanical connector of the expanded connector platform identical to the first mechanical connector.

20. The method of claim 19, further comprising connecting another powered toy building block to the first powered toy building block.

21. The method of claim 15, wherein supplying electrical power includes converting from AC electrical power to DC electrical power using an AC/DC adapter.

22. A powered toy building block lamp combination comprising:

at least one powered toy building block comprising a body and a plurality of block connectors carried thereby, the plurality of block connectors each comprising a non-conductive cylindrical body, at least two conductors traversing the body of the powered toy building block from each block connector to each other block connector, and a light source coupled to the at least two conductors configured to illuminate upon the receipt of direct-current (DC) electrical power;

a lamp having a bulb receptacle supplying alternating-current (AC) electrical power; and a lamp adapter apparatus comprising a socket mount, an expanded connector platform, and a first mechanical connector wherein the first mechanical connector is located on the expanded connector platform and configured to couple to the plurality of block connectors, the socket mount comprising a mount body carrying a socket connector and second mechanical connector, the socket connector configured to couple to the bulb receptacle and receive electrical power therefrom, the expanded connector platform comprising a third mechanical connector configured to be releasably coupled to the second mechanical connector, and an AC/DC adapter coupled to the lamp and the powered toy building block operable to convert the AC electrical power received from the lamp into DC electrical power supplied to the powered toy building block.

* * * * *